United States Patent [19]

Zabielski et al.

[11] 4,237,915

[45] Dec. 9, 1980

[54] HANDI CRUTCH

[76] Inventors: Frank Zabielski, c/o George Spector, 3615 Woolworth Building, 233 Broadway; George Spector, 3615 Woolworth Building, 233 Broadway, both of New York, N.Y. 10007

[21] Appl. No.: 48,747

[22] Filed: Jun. 15, 1979

[51] Int. Cl.[3] ..... A61H 3/02

[52] U.S. Cl. ..... 135/68; 135/73; 135/74; 135/77

[58] Field of Search ..... 135/68–78, 135/84

[56] References Cited

U.S. PATENT DOCUMENTS

| | | | |
|---|---|---|---|
| 127,028 | 5/1872 | Crandall | 135/73 X |
| 595,637 | 12/1897 | Kuhnke | 135/68 |
| 1,621,255 | 3/1927 | Hunter | 135/68 |
| 1,945,460 | 1/1934 | Willis | 135/68 |
| 2,484,406 | 10/1949 | Gibson | 135/68 |
| 2,642,074 | 6/1953 | Pedley et al. | 135/77 X |
| 3,026,887 | 3/1962 | Kirby et al. | 135/68 |
| 3,635,233 | 1/1972 | Robertson | 135/71 |
| 4,184,503 | 1/1980 | Nakajima | 135/68 |

FOREIGN PATENT DOCUMENTS

| | | | |
|---|---|---|---|
| 126298 | 1/1932 | Austria | 135/68 |
| 26486 | 11/1912 | United Kingdom | 135/69 |

*Primary Examiner*—J. Karl Bell

[57] ABSTRACT

A pair of crutches of walker type, each crutch being foldable by being made of sections that snap lock together, a lowest section being hollow to carry tools and other items therewithin, a middle section carrying a folding shelf for holding packages and a top section including a hollow handle for carrying keys and coins while a suspended bag under the handle carries other items, the crutch lower end including interchangable discs to suit different walking surfaces such as grass, concrete and the like.

4 Claims, 3 Drawing Figures

18
17
16
10
21
19
20
12
22
11
15
23
24
28
13
27
29
25
30
26
15
37
14
36
39
38

13
27
35
25
33
35
32
34
31
34

45
3a
3a
40
41
42

41
42

44
43
41
42

HANDI CRUTCH

This invention relates generally to crutches particularly of walker type such as are used by permanently disabled persons.

A principal object of the present invention is to provide a crutch that has more features that are useful to a disabled person than are found on conventional crutches.

More specifically another object is to provide a crutch that includes a retractable shelf upon which packages or newspapers can be carried so that they need not be held by a hand.

Another object is to provide a crutch which has a hollow handle for carrying keys and coins so to be handy, and wherein the crutch is hollow so to have a compartment for carrying tools or other items.

Yet another object is to provide a crutch having a large bottom plate for standing support, and the plate selectively being made non-rigid for easy walking.

Yet a further object is to provide a crutch which is foldable so to easily fit in a car and which is quickly and easily extendable when needed.

Figure 3:
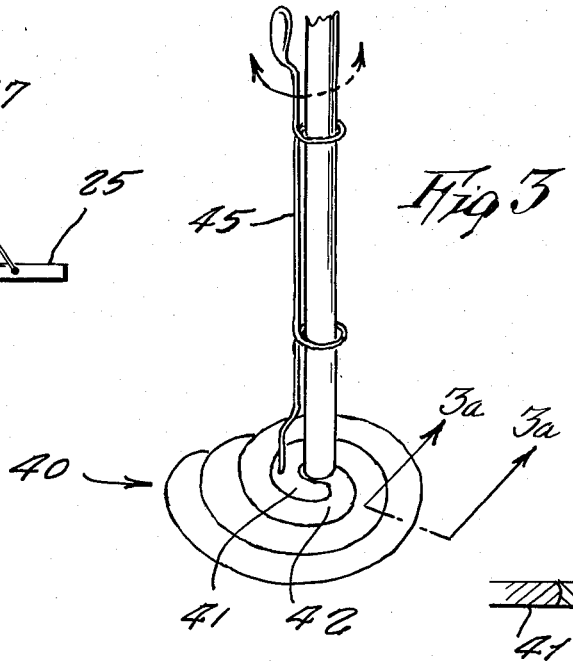
FIG. 3 is a perspective view of a modified design of bottom plate which by flipping a lever either to a right or left, makes the bottom plate either into a stiff plate or else into two flexible spirals that can spring up or down in order to allow easier walking than if they were a solid large diameter plate, by unwinding the spirals, they disengage so to make them springy.
Figure 3A:
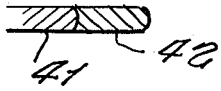
Figure 3B:
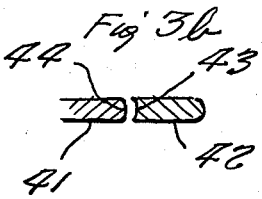

FIGS. 3*a* and 3*b* show cross sectional view on line 3*a*—3*a* of FIG. 3, illustrating the spirals locked together in 3*a*, and disengaged in 3*b*.

Figure 1:
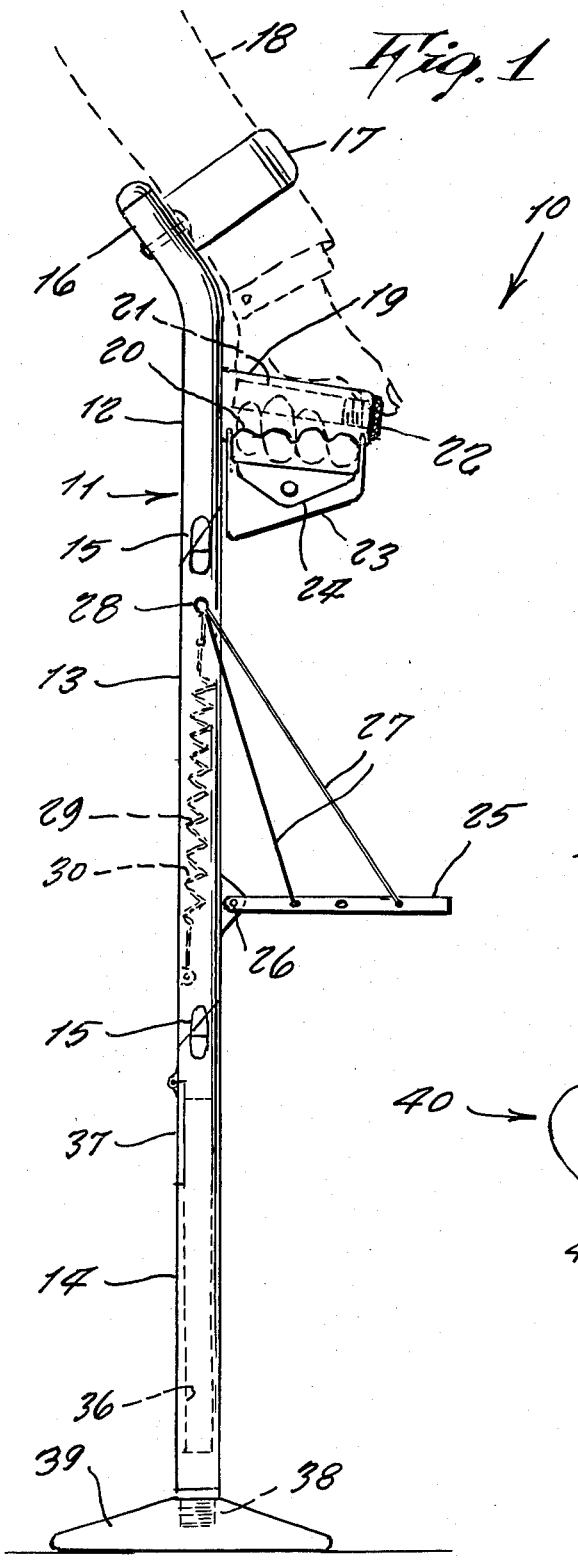
FIG. 1 is a side view of the invention.
Figure 2:
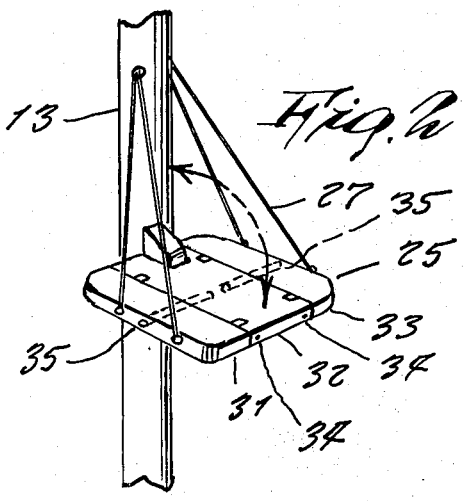
FIG. 2 is a fragmentary perspective of the package carrier shelf.

Referring now to the drawing in greater detail, and more particularly to FIGS. 1 and 2 thereof at this time, the reference numeral 10 represents a hand crutch according to the present invention, wherein the same includes a shaft 11 made of three sections 12,13 and 14 snap locked together by means of locks 15 therebetween so to permit the shaft to fold up when so wished.

A top section 12 includes an inclined upper terminal end 16 to which there is fastened an arm clip 17 for grasping a patient 18. A handle grip 19 is secured to a side of a lower portion of the section, the handle grip having finger-receiving recesses 20 on its underside. The handle grip is made of a soft material and is changable. It includes a compartment 21 therewithin that is accessible by removal of a screwed on end cap 22 so that keys coins or paper money be carried therewithin, and is safe from being snatched by a pick pocket because the grip is being held in a hand, and unscrewing of the cap takes up time.

A separate container or bag 23 is suspended under the handle grip and is closable by a snap fastened sflap 24, the container serving to hold other small articles such as might be often needed so to be handy.

The intermediate section 13 includes a shelf 25 pivotally supported on a pivot pin 26 so in a retracted position it is lifted vertically alongside the section, and in a utility position it extends outward horizontally as shown. It is supported by cords 27 extending out of an openings 28 of the shaft, the inner ends of the cords being attached to tension coil springs 29 which is secured inside a compartment 30 inside the section 13 the spring normally retracting the shelf when not in use. The shelf serves to carry packages or newspapers and the like. As shown in FIG. 2, the shelf is made of three panels 31,32 and 33 that are pivotally attached together by pivot pins 34. Removable transverse pins 35 retain the panels in a rigid flat position so to form the shelf as shown, for holding large packages. However when only a narrow shelf is needed, the pins 35 are removed so that end panels 31 and 33 fold upwardly to form side walls for the panel 32.

A lower most section 14 of the shaft contains a compartment 36 therewithin accessible by a snap locking door 37 on a side that is streamlined flush with the side of the shaft. The compartment 36 serves to hold longer tools or other items. A lower end of section 14 is threaded as shown at 38 so that various discs 39 are interchangably screwed thereto, some discs being more suitable for use on soft ground while others are better for use on concrete. The broad disc gives better support for the patient while standing.

In FIGS. 3,3*a* and 3*b* there is shown a modified design of disc 40 that can selectively be made rigid while a patient stands or which is made flexible while walking so to accomodate an inclination of the shaft during a step being taken.

The disc is made of two spirals 41 and 42 that interfit together by interfitting concave and convex side edges 43 and 44, so to form a rigid single plate, as shown in FIGS. 3 and 3*a*. When a lever 45, freely looped the shaft, is rotated a short distance in one direction around the shaft, the lever lower end, attached to one of the spirals causes the spiral to rotate and thus disengage with the spiral as shown in FIG. 3b so that the disc now forms a flexible plate.

What is claimed:

1. A hand crutch, comprising in combination, a foldable shaft comprised of three sections snap locked together by locks, a top section having an arm clip and handle grip, an intermediate section having an extendable shelf, a lower section having a storage compartment therewithin accessible by a pivotable door, and a lower end thereof being interchangably screwed to one of a plurality of flat discs, one of which is comprised of two spirals rotatable respective to each other so to selectively lock or unlock together.

2. The combination as set forth in claim 1, wherein one said spiral is attached to a lever extending upwardly along side said shaft for manual rotation therearound, and mating side edges of said spirals are grooved to interfit.

3. The combination as set forth in claim 2 wherein said shelf is comprised of three panels hinged together and rigidly affixed together by removable transverse pins, and end panels of said shelf are secured by cords attached to a tension coil spring inside said shaft.

4. The combination as set forth in claim 3, wherein said handle grip contains a compartment accessible by a removable screw cap.

* * * * *